United States Patent [19]

Morgan, Jr. et al.

[11] Patent Number: 4,576,272

[45] Date of Patent: Mar. 18, 1986

[54] COUNTER-TOP OR WALL-MOUNTED VENDING MACHINE

[75] Inventors: Annis R. Morgan, Jr., Atlanta, Ga.; Bernd Mehlan, Herrieden; Josef Gress, Bechhofen, both of Fed. Rep. of Germany; Hugh S. Williford, Atlanta, Ga.

[73] Assignee: The Coca-Cola Company, Atlanta, Ga.

[21] Appl. No.: 623,027

[22] Filed: Jun. 21, 1984

[51] Int. Cl.[4] ..... G07F 5/16

[52] U.S. Cl. ..... 194/215; 221/19

[58] Field of Search ..... 221/125, 266, 14, 18, 221/150 R, 19, 289, 129, 131; 194/10, 1 M, DIG. 19

[56] References Cited

U.S. PATENT DOCUMENTS

| | | | |
|---|---|---|---|
| 1,415,337 | 5/1922 | Grover | 221/19 |
| 2,315,515 | 4/1943 | Gibson et al. | 221/14 |
| 2,353,496 | 7/1944 | Pease . | |
| 2,513,595 | 7/1950 | Stewart | 221/125 |
| 2,546,690 | 3/1951 | Gabrielsen . | |
| 2,562,015 | 7/1951 | Cattanach . | |
| 2,642,171 | 6/1953 | Hamann . | |
| 2,959,979 | 11/1960 | Newberry . | |
| 3,362,582 | 1/1968 | Gasparini . | |
| 3,664,476 | 5/1972 | Mauro . | |
| 4,235,351 | 11/1980 | Kolbl et al. . | |
| 4,437,952 | 9/1982 | Bookout . | |

*Primary Examiner*—Stanley H. Tollberg

*Attorney, Agent, or Firm*—Birch, Stewart, Kolasch & Birch

[57] ABSTRACT

A coin-operated vending machine for bottles or cans of a moderate capacity, including a plurality of side-by-side storage chutes for feeding bottles or cans to openings in the front wall of the vending machine, a cradle in each of the openings forming a row of adjacent cradles for receiving the bottles or cans from the chutes, and a mechanical interlock between the respective cradles for precluding the dispensing of more than one product for any vend cycle. The mechanical interlock also includes a spring-detent assembly for indexing the cradles between closed, intermediate, and fully-open positions in a step-by-step manner. The mechanical interlock is designed to be substantially tamper-proof. A vend chute structure is also provided which permits flexibility of product loading, the free flow of cooling air throughout the vending machine cabinet, and easy cleaning of the vend chute and associated components. The vending machine is adaptable for use on a counter top or mounting to the wall of a building.

19 Claims, 9 Drawing Figures

COUNTER-TOP OR WALL-MOUNTED VENDING MACHINE

BACKGROUND OF THE PRESENT INVENTION

The present invention relates to a refrigerated, automatic vending machine of a low-capacity, for bottles or cans. More specifically, the present invention relates to a refrigerated, automatic, coin-operated vending machine of a suitable size for installation on a counter or as a wall console.

Heretofore coin-operated, automatic vending machines for bottles or cans have generally been designed to include a high storage capacity, to make them suitable for use in large, commercial establishments. Coin-operated vending machines of smaller capacities for use in small office or low-volume sales locations have been rather simplistic in their design. These small-capacity vending machines have, for the most part, not included some of the sophisticated controls and features present in the high-capacity vending machines because of the high cost of some of these controls. However, a need in the art exists for a small capacity coin-operated, automatic vending machine incorporating more sophisticated controls and features than used heretofore, while maintaining a reasonable cost for each vending machine unit.

SUMMARY OF THE PRESENT INVENTION

Accordingly, it is a primary object of the present invention to provide a low-cost, low-capacity vending machine, suitable for use in low-volume vending environments.

It is another object of the present invention to provide a low-capacity vending machine, including a plurality of vend cradles for presenting a variety of selectable products to a customer.

It is still another object of the present invention to provide a mechanical interlock between the cradles for precluding the removal of more than one product in any one vending cycle.

It is a further object of the present invention to provide an indexing mechanism for each cradle in conjunction with the mechanical interlock, which permits the viewing of a product to be vended by a customer in an intermediate open position of the cradle prior to removal of the product from the cradle.

It is still a further object of the present invention to provide a locking means for precluding the opening of any cradle associated with a vend chute which is sold out of products.

It is yet another object of the present invention to provide a vend chute structure which permits added flexibility in the loading of products and cleaning of the vending machine.

It is a further object of the present invention to provide a vend chute structure which permits the loading of products as densely as possible and delivers the products to the cradles on a first-in, first-out basis.

It is still a further object of the present invention to provide an automatic vending machine with a balanced distribution of cooling through the vend chutes and the remainder of the vending machine cabinet.

It is yet another object of the present invention to provide a coin-operated vending machine of a suitable size to facilitate use on a counter top or mounting on a wall of a building.

The objects of the present invention are fulfilled by providing an automatic vending machine including a cabinet having a front wall with at least two openings therein through which products may be vended, at least two product storage chutes disposed within the cabinet in a side-by-side, parallel relationship behind the openings, a cradle disposed in each of the openings forming a row of adjacent cradles for receiving products from the storage chutes when in a closed position with respect to the associated opening, presenting products to a customer for viewing in intermediate, partially-open positions and vending the products in fully-open positions, and mechanical interlock means responsive to the opening of any of the cradles for blocking the opening of any other cradle, the mechanical interlock means including spring detent means for indexing of the cradle between the closed, intermediate, and fully-open positions in a step-by-step manner.

The mechanical interlock means includes a spring-loaded, locking pin supported on the rear side of the front wall of the cabinet adjacent each cradle, each of the locking pins having first and second ends disposed between associated cradle sidewalls on an axis orthogonal to the cradle sidewalls, a vend cam on one of the sidewalls of each of the cradles for operatively engaging a first end of the associated locking pins as the cradle is opened, the vend cam engaging the first end of the locking pin and driving the second end of the locking pin into locking engagement with a cut-out in the sidewall of an adjacent cradle as the cradle is first opened, each of the spring-loaded pins being disposed on a common axis with the ends thereof in abutting relationship through a slot in the sidewall of the cradle opposite the vend cam and the cut-out of the adjacent cradle sidewall, the cut-out being juxtaposed to the vend cam.

The mechanical interlock means further includes binding pins mounted adjacent to each locking pin and movable with the locking pin under the force of the vend cam into an additional locking aperture adjacent to the cut-out. The binding pin is a spring-loaded pin, biased to return to an unlocked position when the force of the vend cam is removed. The binding pin gives extra strength to the mechanical interlock means, making the cradle structures of the vending machine of the present invention tamper-proof.

The spring-detent means for indexing the cradles of the present invention between the respective positions includes the spring-loaded, locking pins described above and a plurality of discrete steps on the above-mentioned vend cams. The vend cam of each cradle including a first step thereon which engages the first end of the locking pin and drives the second end of the locking pin into locking engagement with the cut-out in the sidewall of an adjacent cradle as the cradle is first opened, a second step for engaging the first end of the locking pin when the cradle is in the intermediate positions, and a third step for engaging the first end of the locking pin when the cradle is in the fully-open positions. The first, second and third steps of the vend cam are connected by inclined surfaces along with the first end of the spring-biased, locking pin travels between the respective steps as the cradle is moved from a closed to a fully-open position whereby the first end of the locking pin indexes on each of the steps. Therefore, a customer may open a cradle in a step-by-step manner, stopping at an intermediate position, for viewing a container. Because of the spring-detent means and indexing on the steps of the cams, the customer can feel when the cradle has reached the respective positions throughout the path of travel of the cradle. Therefore, the customer has the option of continuing to open the cradle once the intermediate viewing position is reached, or reclosing the cradle and making another product selection. If the customer could not feel these respective positions provided by the spring-detent means, he would most probably trigger the coin validator mechanism inadvertently when opening a cradle. That is, he would not know the limits of the intermediate position which permits product viewing, and therefore would most probably open the cradle to a fully-open position, completing the vending cycle.

The vending machine of the present invention further includes an additional mechanical interlock means for precluding the opening of any cradle associated with a vend chute which is sold out of product. This additional mechanical interlock means includes a locking lever having a latch end normally biased for locking engagement with an opening in the cradle, but forced out of the opening by the presence of a product thereon, whereby the absence of product permits the locking lever to lock in the opening of the cradle.

The present invention further includes a vend chute structure, including top and bottom shelves defining a serpentine path through which the bottles or cans roll to the respective cradles for vending. The top shelf of the vend chute is vertically pivotable about a hinge to provide access to the bottom shelf for cleaning or product loading. This permits the loading of double tiers of product on the bottom shelf, if desired. The vend chute structure is a self-contained basket which may be removable as a unit from the vending machine for cleaning and so-forth. The vend chute structure is also formed of perforated sheet metal to permit the free flow of cooling air therethrough, or cleaning fluid, if desired.

BRIEF DESCRIPTION OF THE DRAWINGS

The objects of the present invention and the attendant advantages thereof will become more readily apparent by reference to the accompanying drawings wherein.

DESCRIPTION OF PREFERRED EMBODIMENTS

Figure 1:
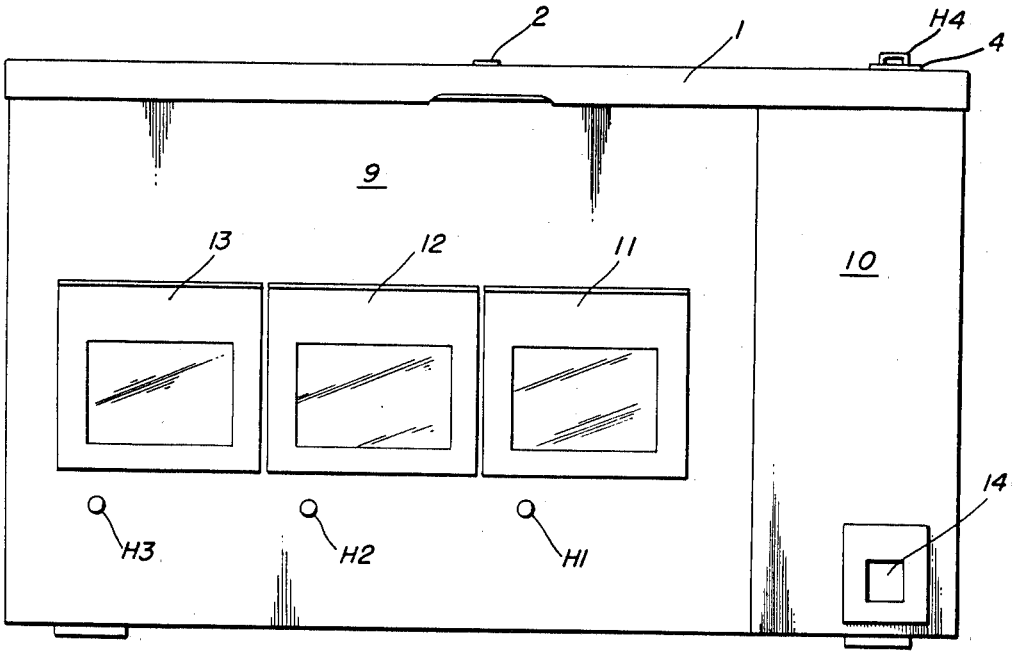
FIG. 1 a elevational view of the automatic vending machine of the present invention.
Figure 2:
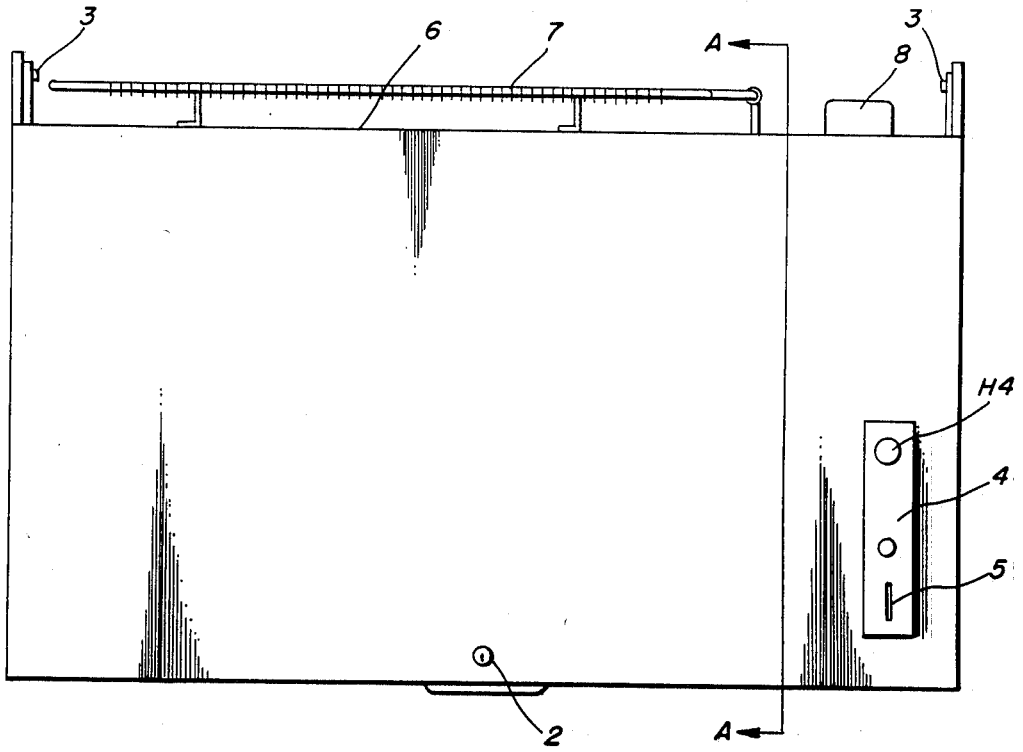
FIG. 2 is a top plan view of the automatic vending machine of FIG. 1.

Referring to FIGS. 1 and 2, the automatic vending machine of the present invention is configured in the form of a chest, whose lid 1 after opening a lock 2 can be folded upwards on hinge brackets 3. A cover plate 4 is disposed in the lid 1 and is provided with a coin slot 5.

Externally on the back wall of the automatic vending machine, a condenser 7 of a cooling unit is mounted. The compressor 8 of this unit is located adjacent the condenser 7.

The automatic vending machine chest has a front wall 9 and a door 10. In the front wall 9 are inset three cradles 11, 12 and 13. To these are attached placards indicating the various product varieties. Below the door 10 a coin return opening 14 is provided. This lies roughly underneath the coin slot 5.

Behind the front wall 9 is a cooler compartment 15. Behind the door 10 is a space 16 containing a coin control unit with a coin tester and coin changer, and a coin collector box.

Figure 3:
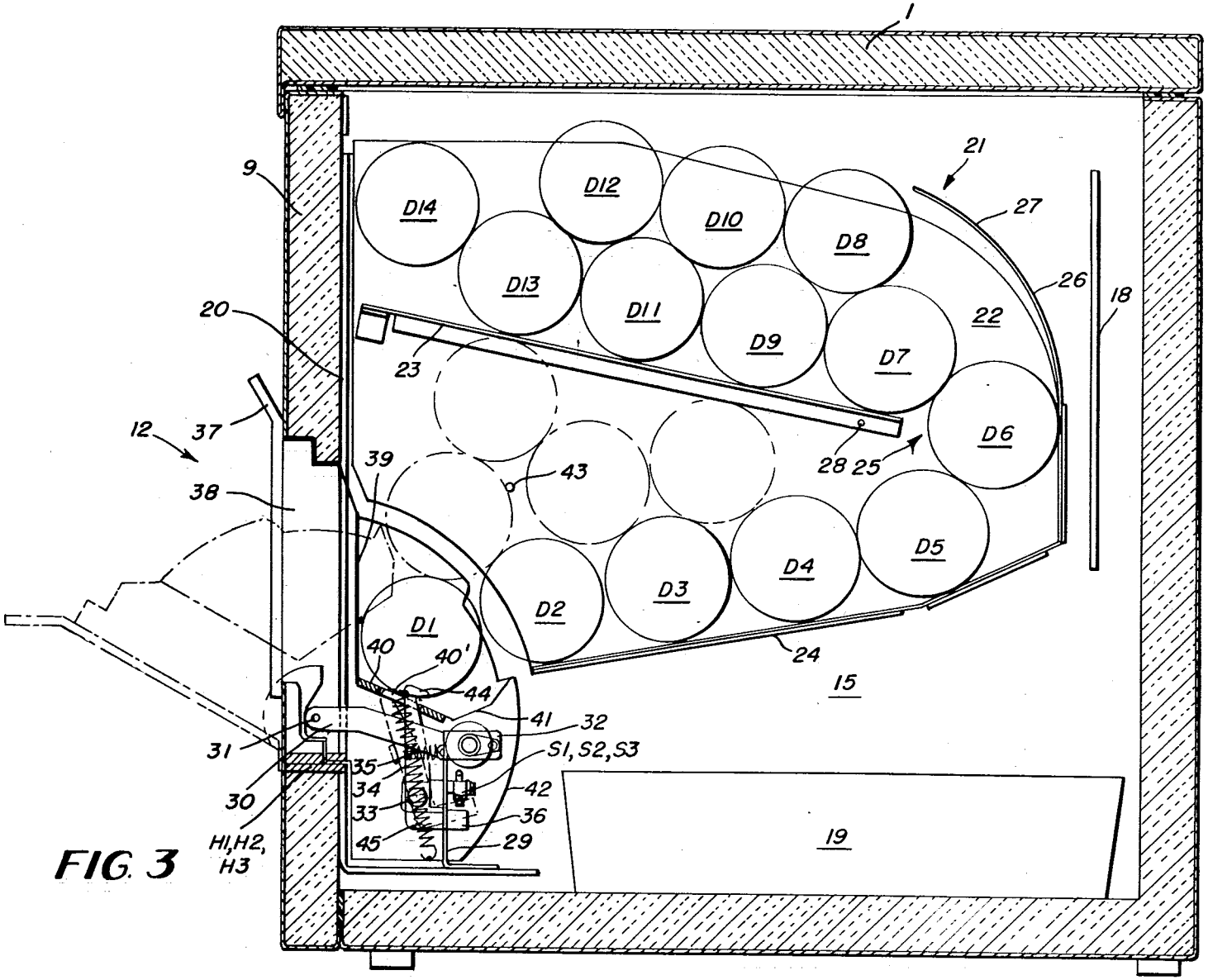
FIG. 3 is a section taken along line A—A of FIGS. 1 and 2 illustrating the cooler compartment of the automatic vending machine and one of a plurality of vend chutes and associated cradle mechanisms.
Figure 9:
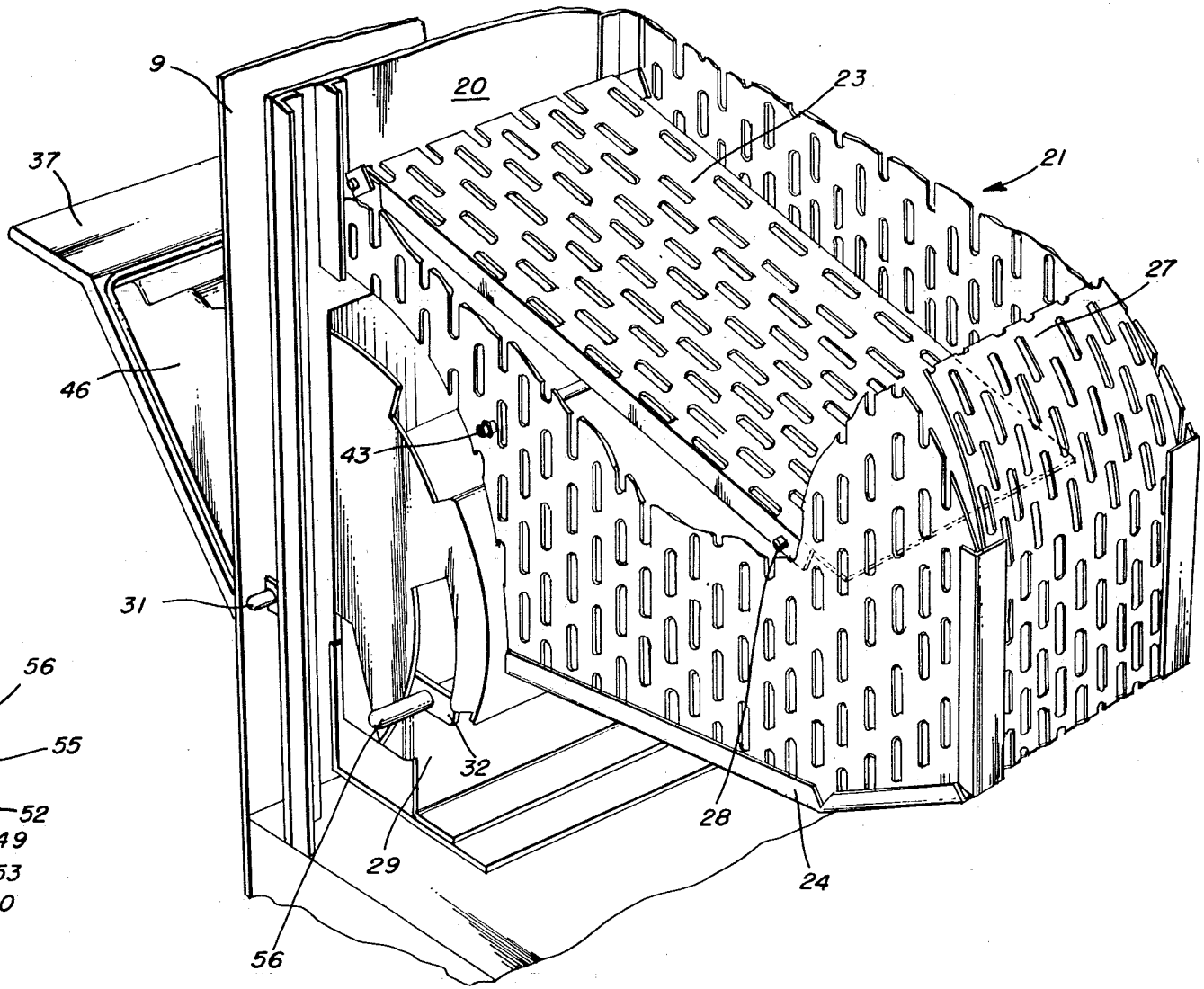
FIG. 9 is a perspective view of a vend chute for use in the vending machine of the present invention.

Between the cooler compartment 15 and the space 16, an internal wall 17 (see FIGS. 4 and 5) is provided. The cooler compartment 15 is thermally insulated on all sides. On the inside of the back wall 6 is an evaporator 18 of the cooling unit, and on the floor of the cooling compartment 15 a drip pin 19 is provided, as illustrated in FIG. 3. Referring further to FIG. 3 and FIG. 9, a bearing plate 20 is attached to the inside of front wall 9. On this, a serpentine basket 21 is arranged, in which are configured alongside each other three chutes 22 operatively associated with the three cradles, 11, 12 and 13. Each chute has a rearward-slanting upper shelf 23 and a frontward-slanting lower shelf 24. At the back is a passageway 25 provided with a width corresponding to the diameter of the cans D1 to D14. On lower shelf 24, the cans D2 to D5 lie in a single tier. However, a double tier of cans may be loaded thereon (see cans in dotted lines) by pivoting the upper shelf 23 about hinge pin 28 to provide access to the lower shelf 24. On the upper support plate 23, the cans D7 to D14 lie in a double tier. In order to guide the cans of the upper tier to the passageway 25, a rear wall 26 of the chute 22 is provided with a curved portion 27.

The upper shelf 23 is manually pivotable upwards around a hinge pin 28. The shelves 23 and 24 and the rear wall 26, as well as the sidewalls of the chutes 22, are fabricated out of perforated sheet metal. In this way, the cooling circulation in cooler compartment 15 is virtually unimpeded.

A mechanical support bracket 29 is attached to bearing plate 20. The bracket has hinge brackets 30 for a hinge rod 31, on which the three cradles 11, 12 and 13 are installed. The mechanical support bracket 29 is provided with further hinge brackets 32 in the vicinity of each of the cradles 11, 12 and 13. A sold-out locking lever 34, which is loaded by a spring 35, is fitted on lug 33 of mechanical support bracket 29 in the vicinity of each of the cradles 11, 12 and 13. The sold-out locking lever 34 has a switch arm 36 for the actuation of sold-out switches S1, S2 and S3 below the respective cradles.

The cradles 11, 12 and 13 are mounted so as to pivot on hinge rod 31. The cradle is shown in FIG. 3 in its closed position by continuous lines and in the open position by broken lines. Externally, the cradle 11, 12 and 13 has a pull plate 37 attached to an isolating component 38. The side of this, turned away from the pull plate 37, forms an inside surface piece 39, to which a pickup, base plate 40 is attached by an obtuse angle. The pickup, base plate 40 turns into a roll-on surface 41 through an obtuse angle. To this is attached a support curve 42. Above the roll-on surface 41 in the chute 22 is located a package stop 43. The details of the cradle structure are fully disclosed in U.S. Pat. No. 4,235,351 to Kolbl, et al., issued Nov. 25, 1980.

The pickup, base plate 40 is provided with a slot 40′ for the sold-out locking lever 34. A can lying on the pickup, base plate 40, while cradles 11, 12 and 13 are in the closed position, pivots sold-out locking lever 34 against the pressure of spring 35 in the manner shown by the broken lines in FIG. 3. The sold-out locking lever 34 then actuates the corresponding sold-out switches S1, S2 and S3. If cradles 11, 12 and 13 have no can lying on pickup base plate 40, spring 35 then pulls sold-out locking lever 34 in such a way that a tongue 44 formed in it, engages slot 40′ so that the cradles 11, 12 and 13 can no longer be swung out and the corresponding sold-out switches S1, S2 and S3 are no longer actuated. This position of the sold-out locking lever 34 is illustrated in FIG. 3 by continuous lines. Under each cradle 11, 12 and 13 and located in front wall 9 is an indicator lamp H1, H2 and H3. These light up if the sold-out locking lever 34 does not actuate the switches S1, S2 and S3, and thus if the corresponding chute 22 is empty. This sold-out feature will be more fully described hereinafter with reference to FIG. 6.

A tension spring 45, which is attached to support plate 20, acts on each cradle 11, 12 and 13. The tension spring 45 pulls the cradles 11, 12 and 13 from their open position into their closed position.

Figure 4:
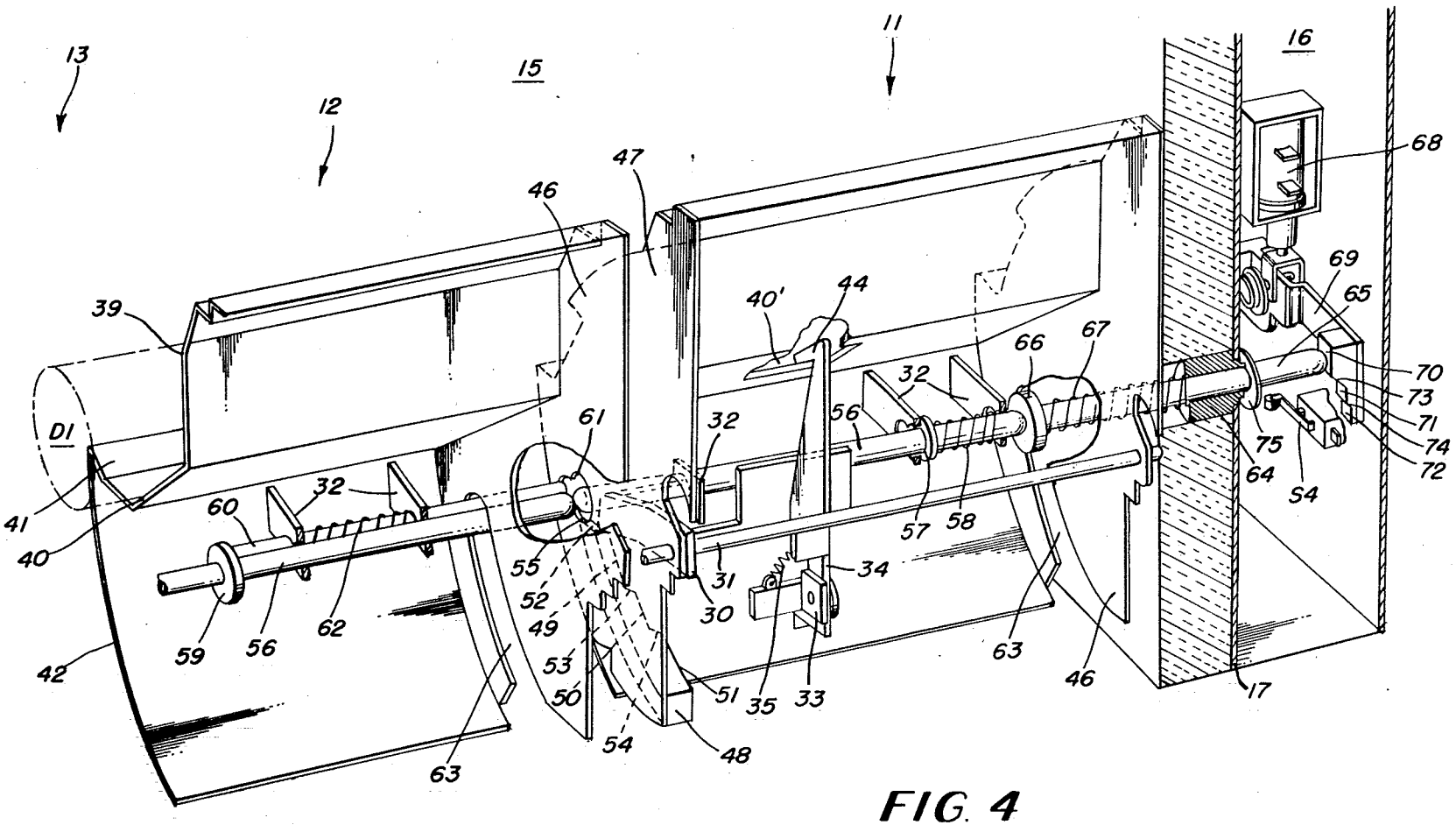
FIG. 4 is a partial view in perspective of two of the cradle mechanisms in the closed position, as viewed from the front of the vending machine.
Figure 5:
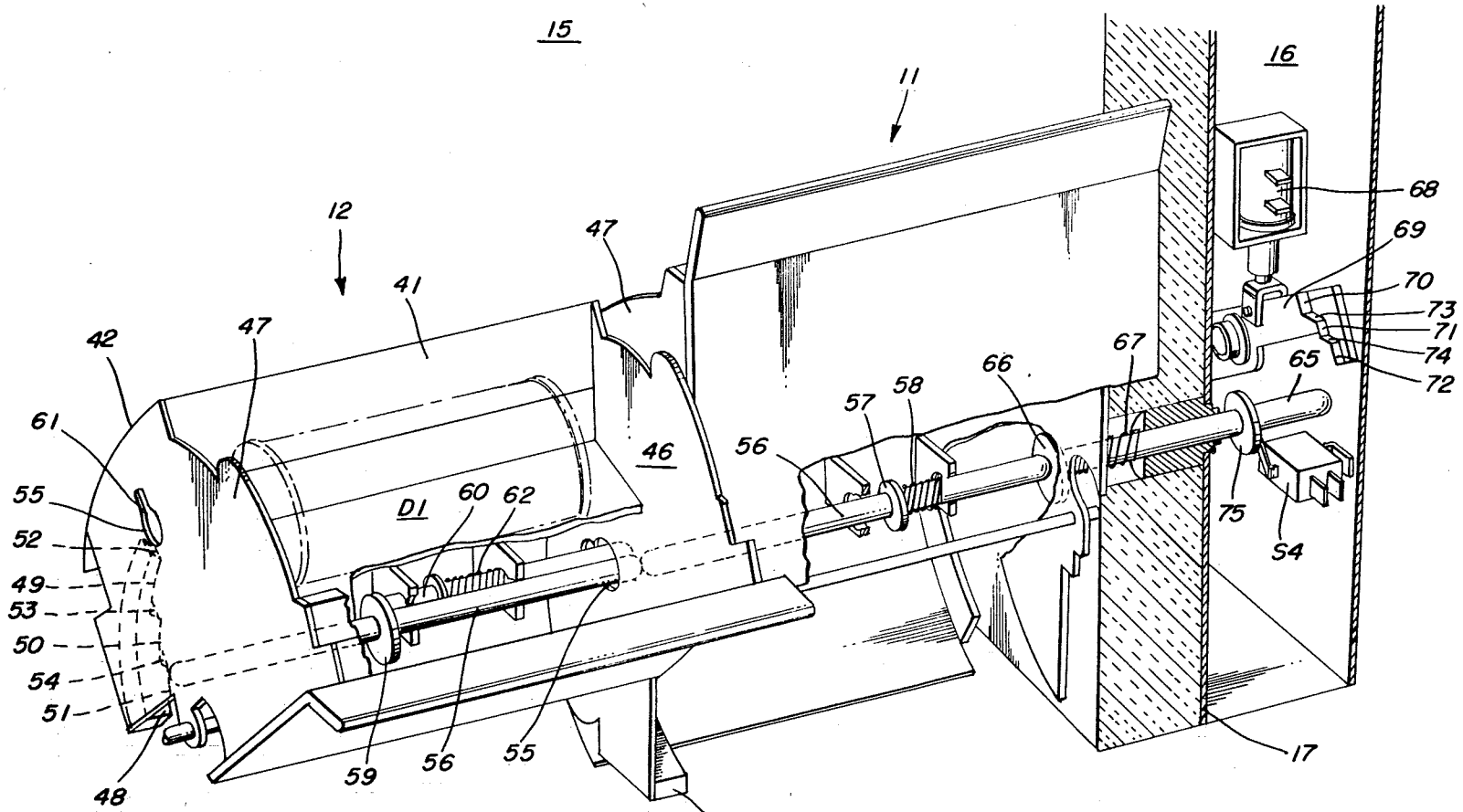
FIG. 5 is a partial view in perspective of the two of the cradle mechanisms of FIG. 4 in which one cradle is open.

FIGS. 4 and 5 illustrate the operation of the cradles 11, 12 and 13. Cradle 13 is not shown for the sake of clarity. However, it should be understood that cradle 13 would be disposed to the left of cradle 12, as viewed in FIGS. 4 and 5. Also, there is no theoretical limit to the number of cradles or associated chutes which may be used, although three are preferred for the purposes of the present invention.

Figure 7:
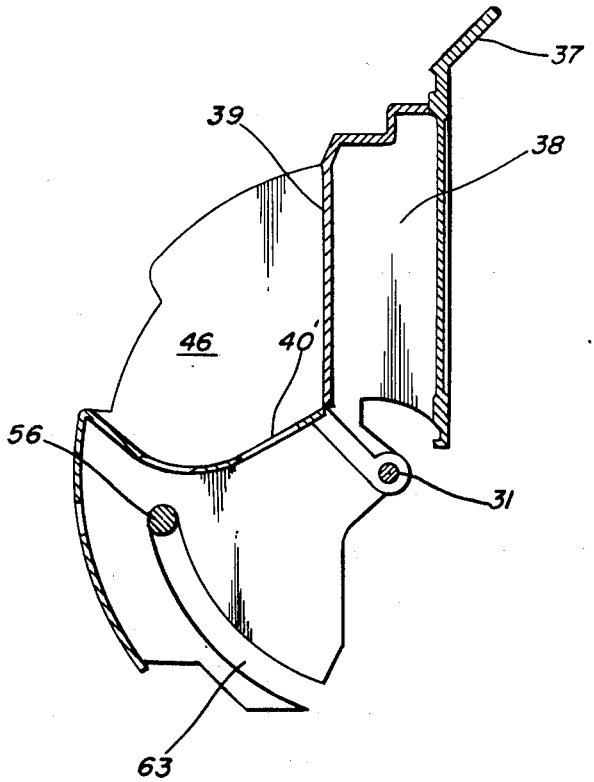
FIG. 7 is a plan view of the inside surface of the right sidewall of a cradle for use in the vending machine of the present invention.
Figure 8:
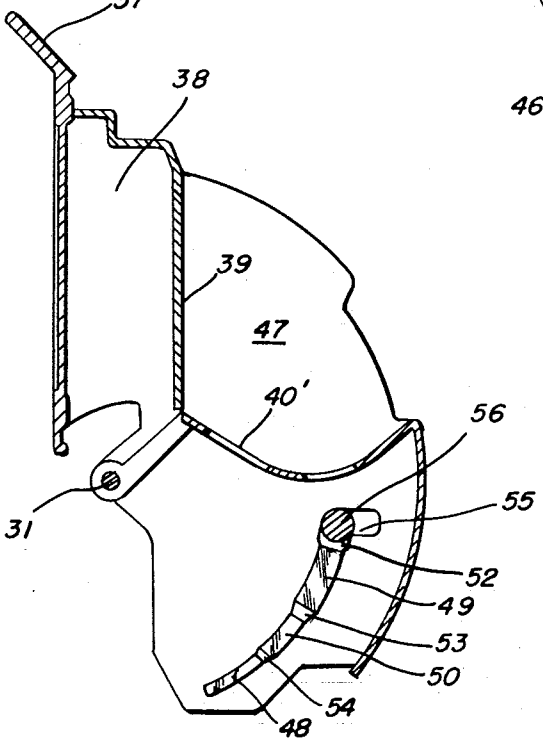
FIG. 8 is a plan view of the inside surface of the left sidewall of a cradle for use in the vending machine of the present invention.

Each cradle 11, 12 and 13 has a right sidewall 46 (FIG. 7) and a left sidewall 47 (FIG. 8). A vend cam 48 is attached to each left sidewall 47. Vend cam 48 of the right-hand cradle 11 is also illustrated in FIGS. 4 and 5. Three steps 49, 50 and 51 are formed on vend cam 48. An incline 52 leads from the sidewall 47 onto the step 49. An incline 53 leads from the step 49 to the step 50. An incline 54 leads from the step 50 to the step 51. On the sidewall 47 of the cradles 11 and 12, a cutout 55 is provided in front of incline 55.

A locking pin 56 is provided on the hinge bracket 32 for each cradle 11, 12 and 13. The locking pins 56 lie on a common axis and push against each other in the area of the cutouts 55. The locking pin 56 of the right-hand cradle 11 (FIGS. 4 and 5) has a collar 57, against which a spring 58 pushes, which biases the locking pins 56 leftwards. A disk 59 is fixed on the locking pins 56 of cradles 12 and 13, and against it pushes one end of a binding pin 60, at whose other end an extension 61 of cutout 55 is located. The binding pin 60 is pressed against disk 59 by means of a spring 62. The right sidewall 46 of cradles 11, 12, 13 has a slot 63, through which the locking pin 56 or the locking pin 56 and and the binding pin 60 protrude. Slot 63 is best illustrated in FIG. 7.

A locking rod 65 extends through the internal wall 17 in a bushing 64. An endplate 66 thereon normally pushes against the locking pin 56 of cradle 11. The endplate 66 for the locking rod 65 is biased against the locking pin 56 by means of a spring 67. The opposite end of the locking rod 65 lying in the space 16 is normally engaged by a blocking cam 69, rotatable by means of an electromagnet 68. This cam has three steps 70, 71 and 72, which communicate with each other by means of inclines 73 and 74.

A control disk 75 operatively associated with an electrical switch S4 is provided and is attached to locking rod 65 in the space 16. In the position of the blocking cam 69 illustrated in FIG. 4, the locking rod 65 lies against the step 70. All cradles 11, 12 and 13 are closed. If an attempt is made to rotate one of the cradles 11, 12, 13, then the vend cam 48 presses with its incline 52 against the locking pin 56. The latter can therefore not displace itself towards the right because it is the locking rod 65 which lies against the step 70. Thus, none of the cradles 11, 12, 13 can be opened.

In the position shown in FIG. 5, the blocking cam 69 is swung out of the path of travel of the locking rod 65. Should one of the cradles, the cradle 12 in the representation according to FIG. 5, be opened, incline 52 then strikes the locking pin 56 in cradle 12 and displaces it rightwards. Locking pin 56 in cradle 12 thereby engages the cutout 55 of the cradle 11, so that cradle 11 is blocked from rotation, and thus cannot be opened. The left cradle 13 (to the left of cradle 12 but not shown) cannot be opened, because the cutout 55 of the sidewall 47 of the cradle 12 is swung out of the path of travel of a locking pin 56 in cradle 13, so that the locking pin 56 of the cradle 13 cannot be displaced when it is impinged by its associated incline 52, since it pushes against the sidewall 47 of the cradle 12. In the process of further opening of the cradle 12, the locking rod 56 thereof arrives on the step 50. In this position the can D1 lying in the cradle 12 cannot be taken out. The purchaser can, however, already see the can D1, as illustrated in FIG. 5.

Subsequently, the locking pin 56 arrives on the step 51. Once in this position, the locking pin 56 and the locking rod 65 are so far displaced that their control disk 76 closes the switch S4. Coins previously inserted are now deposited in the coin box and the can D1 can be taken out.

With the displacement of the locking pin 56, the binding pin 60 will be pushed into the extension 61 by the disk 59. The play between the binding pin 60 and the extension 61 is smaller than the play between the locking 56 and the cutout 55. If the cradle 11 is moved slightly while the cradle 12 is open, then it can engage neither the binding pin 60 nor the locking pin 56 tightly, so that these can be displaced leftwards to the original positions thereof when the cradle 12 is closed as a result of the pressure of the springs 67 and 68. Binding pin 60 also gives added strength to the locking mechanism, making it substantially tamper-proof.

When the switch S4 is opened, the electromagnet 68 is de-energized or reset, so that the blocking cam 69 drops onto the locking rod 65. The cradle 12 now starts to close, when the locking pin 56 arrives on the step 50 of vend cam 48 thereof under pressure of the springs 67 and 58. The step 72 of the blocking cam 59 thus comes into the path of travel of the locking rod 65, so that the cradle 12 cannot be re-opened. With a further closing of the cradle 12, the locking pin 56 arrives on the step 49.

Accordingly, the blocking cam 69 drops down so far that its step 71 lies in the pathof travel of the locking rod 65. Thereafter, the cradle 12 arrives in its fully-closed position, and thus the step 70 lies in the path of travel of the locking rod 65. Through the combined action of the steps 49, 50 on vending cam 48 and the steps 71, 72 on blocking cam 69, a reverse lock is created, so that the purchaser, after having once completely opened one cradle 11, 12, and 13, cannot open it a second time without an additional deposit of coins.

In the open position of the cradles 11, 12, 13, only the cans lying inside it can be removed, and the next following cans are restrained by the support curve 42. Access to them is prevented by the raised, roll-on surface 41. After release of the cradles 11, 12 and 13, the tension spring 45 draws the cradles back into closed position.

Figure 6:
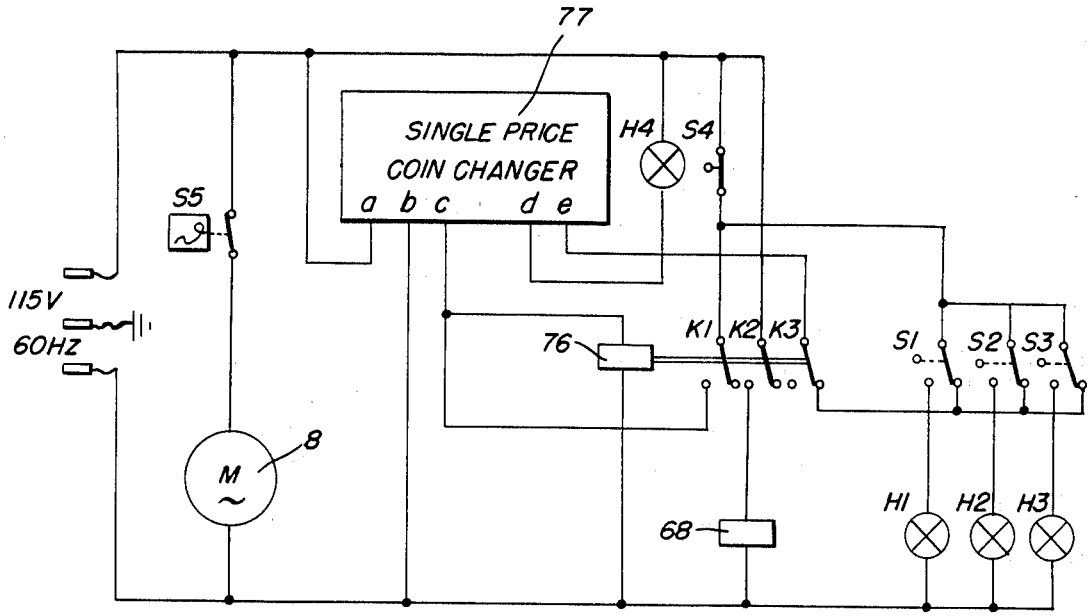
FIG. 6 is an electrical circuit diagram of the vending machine coin changer, power supply and electromechanical controls.

In the circuit diagram shown in FIG. 6, the compressor 8 is coupled to the main power supply by the thermostat switch S5. Inputs a and b of coin changer 77 are connected with the main power supply. To an ouput c of coin changer 77 is connected a relay 76, which has switching contacts K1, K2 and K3. Connected to an output d is an indicator lamp 4 which lights up when no more change is stored in the coin changer. The purchaser then has to insert the exact change.

The switching contact K3 is connected to an input e. If there if no voltage at the input e, the coin changer will not accept coins.

The switch S4 is the main power switch, and is connected in series with contact K1. Also in series with switch S4 is the parallel circuit including sold-out switches S1, S2 and S3, each having one pole thereof connected with the contact K3. The other poles of switches S1, S2 and S3 are connected with the lamps H1, H2 and H3, respectively.

The electromagnet 68 is connectable to the main power supply through switching contact K2.

DESCRIPTION OF OPERATION

The circuit conditions illustrated in FIG. 6 assume a full vending machine with cradles 11, 12, and 13 closed, as illustrated in FIG. 4. A vend cycle begins when coin changer 77 accepts coins. If coins corresponding to the purchase price are inserted, there is an impulse at the output c of the coin changer 77. Thereupon contacts K1, K2 and K3 switch from the positions indicated in FIG. 6 to the opposite pole positions. Through the contact K1, relay 76 keeps itself closed as long as switch S4 is closed. Through the switching over of contct K2, the electromagnet 68 is energized, so that the blocking cam 69 is rotated into the position represented in FIG. 5, out of engagement with the end of shaft 65. The input e has current switched off it by the contact K3, so that the coin changer 77 accepts no further cons. Now one of the cradles 11, 12, 13 can be opened in the manner described. Until locking pin 56 moves as far as the incline 54, this cradle can be closed again without credit being lost. However, once locking pin 56 is located on the step 51, then switch S4 is closed by control disk 75 and the coins fall from the coin changer 77 into the coin box. The coin changer 77 may be a Coin Acceptor S75-9800B.

The self-holding current of the relay 76 is interrupted by the opening of the switch S4, so that it resets to the positions of FIG. 6. Thereupon the magnet 68 is de-energized so that the blocking cam 69 drops down. Now coin acceptance can no longer take place, since the input e is without current with switch S4 opened.

If cradle 11, 12, 13 starts to close again after delivery, the switch S4 then opens as soon as locking pin 56 arrives at step 50. The coin changer 77 once more can accept coins. As soon as the corresponding cradle 11, 12, 13 is completely closed, the next product rolls into it.

If one of the chutes 22 is empty, the appropriate switch S1, S2 or S3 is actuated by its corresponding lamp H1, H2 or H3 is lit. As long as at least one chute 22 is occupied, coin acceptance is possible. An empty cradle cannot be opened since it is blocked by its sold-out locking lever 34.

Should all the chutes 22 be empty, current is switched off the input e by the switches S1, S2 and S3, so that no coins are accepted.

For service or cleaning operations, the serpentine basket 21 which is attached to the bearing plate 20, together with the mechanical support bracket 29, can be withdrawn from the cooler compartment 15. In the course of this, the locking pin 56 of the cradle 11 disengages from the end plate 66 of locking rod 65. The spring 58 holds the locking pin 56 in such a way that an operating check can be performed even outside of the cooler compartment 15.

It should be understood that the system described herein may be modified, as would occur to one of ordinary skill in the art without departing from the spirit and scope of the present invention.

What is claimed is:

1. An automatic vending machine comprising:

a cabinet having a front wall with at least two openings therein through which products may be vended;

at least two product storage chutes disposed within said cabinet in a side-by-side, parallel relationship behind said openings;

a cradle disposed in each of said openings forming a row of adjacent cradles for receiving products from said at least two chutes when in a closed position with respect to the associated opening and vending said products in fully open positions;

indexing means for moving and stopping said cradle at a partially-open position intermediate to said closed and fully open position, said partially-open position permitting products to be viewed but not removed by a customer from said cradle; and mechanical interlock means responsive to the opening of any of said cradles for blocking the opening of any other cradle.

2. The vending machine according to claim 1, wherein said cradle includes a front wall for covering an associated opening in the front wall of said cabinet, a pair of side walls, and a rear wall on which products from associated chutes are received, and said mechanical interlock means and spring detent means thereof include a spring-loaded locking pin supported on the rear side of the front wall of said cabinet adjacent each said cradle, each said locking pin having first and second ends disposed between the associated cradle sidewalls on an axis orthogonal to said cradle sidewalls, a vend cam on one of the sidewalls of each of said cradles for operatively engaging a first end of the associated locking pins as the cradle is opened, said vend cam having a first step thereon which engages said first end of the locking pin and drives the second end of the locking pin into locking engagement with a cut-out in the sidewall of an adjacent cradle as the cradle is first opened, said cam having a second step for engaging said first end of said pin when said cradle is in said intermediate positions, said vend cam having a third step for engaging said first end of said pin when said cradle is in said fully open positions, said first, second and third steps being connected by inclined surfaces along which said first end of the spring-biased pin travels between said steps as said cradle is moved from a closed to fully-opened positions, whereby said first end of said pin indexes on each of said steps.

3. The vending machine according to claim 2, wherein each of said spring-loaded pins are disposed on a common axis with the ends thereof in abutting relationship through a slot in the sidewall of said cradle opposite said vend cam and the cut-out of the adjacent cradle sidewall, said cut-out being juxtaposed to said first step of said vend cam.

4. The vending machine according to claim 3, further comprising:

binding pin means mounted adjacent each said locking pin and movable with said locking pin under the force of said vend cam into a locking aperture adjacent to said cut-out.

5. The vending machine according to claim 4, wherein said binding pin means is a spring-loaded pin biased to return to an unlocked position when the force of said vend cam is removed.

6. The vending machine according to claim 3, further comprising:

coin validator means for receiving coins, calculating the value thereof, and establishing a vend credit signal when the proper value of coins is received;

primary locking means for precluding the opening of any of said cradles to the fully-open position until a vend credit signal is established by said coin validator means, said primary locking means including a locking shaft disposed on said common axis with said locking pins and having a first end in abutting relationship with the second end of the locking pin of a cradle at an end of said row of cradles, a blocking cam normally operatively engaging a second end of said locking shaft and blocking the longitudinal movement thereof, and means for moving said blocking cam out of engagement with said second end of said shaft in response to said vend credit signal.

7. The vending machine according to claim 6, further comprising:

switch means responsive to movement of said shaft as a cradle is opened for enabling said coin validator means to calculate the value of said coins when the first end of the associated locking pin of the cradle being opened indexes on said third step of said vend cam.

8. The vending machine according to claim 7, further comprising:

reset means responsive to the closing of an opened cradle to a position where the first end of the associated locking pin indexes on the second step of said vend cam for moving said blocking cam back into engagement with the second end of said shaft until a subsequent vend credit signal is established.

9. The vending machine according to claim 8, wherein said blocking cam has first, second and third steps connected by inclined surfaces on which said second end of said locking shaft indexes, said second end of said locking shaft indexing on said first step when all cradles are fully closed, indexing on said second step when the first end of any one of said locking pins indexes on the first step of an associated vend cam, and indexing on said third step when any one of the first ends of said locking pins indexes on the second step of an associated vend cam, all three steps of said blocking cam precluding the opening of all cradles when the second end of said locking shaft is indexed thereon.

10. The vending machine according to claim 9, wherein said first and second steps of said blocking cam also preclude the actuation of said switch means when the second end of said locking shaft is indexed thereon.

11. An automatic vending machine comprising:

a cabinet having a front wall with at least two openings therein through which products may be vended;

at least two product storage chutes disposed within said cabinet in a side-by-side, parallel relationship behind said openings;

a cradle disposed in each of said openings forming a row of adjacent cradles for receiving products from said at least two chutes when in a closed position with respect to the associated opening, presenting products to a customer for viewing in intermediate, partially-open positions and vending said products in fully-open positions, said cradle including a front wall for covering an associated opening in the front wall of said cabinet, a pair of sidewalls, and a rear wall on which products from associated chutes are received; and mechanical interlock means responsive to the opening of either of said cradles for blocking the opening of any other cradle, including a spring-loaded locking pin supported on the rear side of the front wall of said cabinet adjacent each said cradle, each said locking pin having first and second ends disposed between the associated cradle sidewalls on an axis orthogonal to said cradle sidewalls, a vend cam on one of the sidewalls of each of said cradles for operatively engaging a first end of the associated locking pins as the cradle is opened, said vend cam engaging said first end of the locking pin and driving the second end of the locking pin into locking engagement with a cut-out in the sidewall of an adjacent cradle as the cradle is first opened, each of said spring-loaded pins being disposed on a common axis with the ends thereof in abutting relationship through a slot in the sidewall of said cradle opposite said vend cam and the cut-out of the adjacent cradle sidewall, said cut-out being juxtaposed to said vend cam.

12. The vending machine according to claim 11, further comprising:

binding pin means mounted adjacent each said locking pin and movable with said locking pin under the force of said vend cam into a locking aperture adjacent to said cut-out.

13. The vending machine according to claim 12, wherein said binding pin means is a spring-loaded pin biased to return to an unlocked position when the force of said vend cam is removed.

14. The vending machine according to claim 3, further comprising:

coin validator means for receiving coins, calculating the value thereof, and establishing a vend credit signal when the proper value of coins is received;

primary locking means for precluding the opening of any of said cradles to the fully-open position until a vend credit signal is established by said coin validator means, said primary locking means including a locking shaft disposed on said common axis with said locking pins and having a first end in abutting relationship with the second end of the locking pin of a cradle at an end of said row, a blocking cam normally operatively engaging a second end of said locking shaft and blocking the longitudinal movement thereof, and means for moving said blocking cam out of engagement with said second end of said shaft in response to said vend credit signal.

15. The vending machine according to claim 14, further comprising:

switch means responsive to movement of said shaft as a cradle is opened for enabling said coin validator means to calculate the value of said coins.

16. The vending machine according to claim 11, further including sold-out interlock means responsive to the absence of products in any one chute for blocking the opening of the cradle associated with that chute.

17. The vending machine according to claim 16, wherein said sold-out interlock means comprises a locking lever having a latch end normally biased for locking engagement with an opening in said cradle but forced out of said opening by the presence of product thereon, whereby the absence of product permits the locking lever to block the opening of said cradle.

18. An automatic vending machine comprising:

a cabinet having a front wall with at least two openings therein through which products may be vended;

at least two product storage chutes disposed within said cabinet in a side-by-side, parallel relationship behind said openings;

a cradle disposed in each of said openings forming a row of adjacent cradles for receiving products from said at least two chutes when in a closed position with respect to the associated opening and vending said products in fully-open positions;

indexing means for moving and stopping said cradle at a partially-open position intermediate to said closed and fully-open position, said partially-open position permitting products to be viewed but not removed by a customer from said cradle; and mechanical interlock means responsive to the absence of products in any one chute for blocking the opening of the cradle associated with that chute.

19. The vending machine according to claim 18, wherein said mechanical interlock means comprises a locking lever having a latch end normally biased for locking engagement with an opening in said cradle but forced out of said opening by the presence of product thereon, whereby the absence of product permits the locking lever tolockin the opening of said cradle.

* * * * *